US009895725B1

(12) United States Patent
Chong et al.

(10) Patent No.: US 9,895,725 B1
(45) Date of Patent: Feb. 20, 2018

(54) DISK CLAMP AND MOTOR HUB CLEANING WITH STAMPING ADHESIVE

(71) Applicant: Western Digital Technologies, Inc., Irvine, CA (US)

(72) Inventors: Jin Yang Chong, Subang Jaya (MY); Yih Fey Chang, Kepong (MY); Lie Dhani Hastama, Petaling Jaya (MY)

(73) Assignee: Western Digital Technologies, Inc., San Jose, CA (US)

( * ) Notice: Subject to any disclaimer, the term of this patent is extended or adjusted under 35 U.S.C. 154(b) by 622 days.

(21) Appl. No.: 14/508,870

(22) Filed: Oct. 7, 2014

(51) Int. Cl.

| | |
|---|---|
| ***B08B 1/00*** | (2006.01) |
| ***B08B 7/00*** | (2006.01) |
| ***B08B 11/02*** | (2006.01) |

(52) U.S. Cl.
CPC ..... *B08B 7/0028* (2013.01); *B08B 1/007* (2013.01); *B08B 11/02* (2013.01)

(58) Field of Classification Search
CPC B08B 1/00; B08B 1/001; B08B 1/007; B08B 11/00; B08B 11/02
See application file for complete search history.

(56) References Cited

U.S. PATENT DOCUMENTS

| | | | |
|---|---|---|---|
| 6,049,973 | A | 4/2000 | Frank, Jr. et al. |
| 6,467,153 | B2 | 10/2002 | Butts et al. |
| 6,651,192 | B1 | 11/2003 | Viglione et al. |
| 6,657,801 | B1 | 12/2003 | Chue et al. |
| 6,687,093 | B1 | 2/2004 | Butler et al. |
| 6,751,041 | B1 | 6/2004 | Codilian et al. |
| 6,788,480 | B1 | 9/2004 | Codilian et al. |
| 6,791,782 | B1 | 9/2004 | Codilian et al. |
| 6,792,669 | B2 | 9/2004 | Codilian |
| 6,798,592 | B1 | 9/2004 | Codilian et al. |
| 6,894,861 | B1 | 5/2005 | Codilian et al. |
| 6,896,741 | B2 | 5/2005 | Stelcher |
| 6,897,393 | B1 | 5/2005 | Codilian et al. |
| 6,898,044 | B1 | 5/2005 | Chheda |
| 6,943,972 | B1 | 9/2005 | Chue et al. |
| 7,003,626 | B1 | 2/2006 | Chheda et al. |
| 7,027,242 | B1 | 4/2006 | Terrill et al. |
| 7,046,467 | B1 | 5/2006 | Chheda |
| 7,058,759 | B1 | 6/2006 | Reiser et al. |
| 7,072,129 | B1 | 7/2006 | Cullen et al. |
| 7,076,391 | B1 | 7/2006 | Pakzad et al. |
| 7,076,603 | B1 | 7/2006 | Chheda |
| 7,136,242 | B1 | 11/2006 | Chue et al. |
| 7,139,145 | B1 | 11/2006 | Archibald et al. |
| 7,145,744 | B1 | 12/2006 | Clawson et al. |

(Continued)

*Primary Examiner* — Randall Chin
(74) *Attorney, Agent, or Firm* — Chang & Hale LLP

(57) ABSTRACT

An assembly configured to clean one or more selected structures of a device may comprise an end effector assembly, a material disposed on a surface of the end effector assembly that, in operation of the device, faces the selected structure(s) of the device. The end effector assembly may be configured to selectively move the material towards and against the selected structure(s) such that the material remains on the facing surface of the end effector assembly and to retain, when the end effector assembly is moved away from the device, at least some particulates previously on the selected structure(s). The device may comprise a data storage assembly and the selected structures may comprise a spindle motor hub and a disk clamp to secure the clamp to the disk.

19 Claims, 5 Drawing Sheets

(56) References Cited

U.S. PATENT DOCUMENTS 7,178,432 B1 2/2007 Han et al.
7,199,959 B1 4/2007 Bryant
7,203,020 B1 4/2007 Viglione et al.
7,209,310 B1 4/2007 Tsai et al.
7,222,410 B1 5/2007 Klassen et al.
7,236,911 B1 6/2007 Gough et al.
7,269,525 B1 9/2007 Gough et al.
7,458,123 B2 * 12/2008 Grube ..... B08B 7/0028 15/1.51
7,458,282 B1 12/2008 Wuester, Sr. et al.
7,490,398 B1 2/2009 Klassen et al.
7,506,553 B1 3/2009 Panyavoravaj
7,549,204 B1 6/2009 Vangal-Ramamurthy et al.
7,552,526 B1 6/2009 Klassen et al.
7,559,590 B1 7/2009 Jones
7,561,416 B1 7/2009 Sarraf
7,596,722 B1 9/2009 Pakzad et al.
7,634,375 B1 12/2009 Pakzad et al.
7,653,983 B1 2/2010 Klassen
7,669,711 B1 3/2010 Westwood
7,671,599 B1 3/2010 Tan et al.
7,673,638 B1 3/2010 Boynton et al.
7,690,705 B1 4/2010 Roberts et al.
7,743,486 B1 6/2010 Klassen et al.
7,863,889 B1 1/2011 Bamrungtham
7,869,182 B1 1/2011 Tan et al.
7,869,183 B1 1/2011 Tan et al.
7,874,424 B1 1/2011 Westwood
7,896,218 B2 3/2011 Rakpongsiri et al.
7,900,272 B1 3/2011 Tan et al.
7,912,666 B1 3/2011 Pakzad et al.
7,916,599 B1 3/2011 Panyavoravaj et al.
7,921,543 B2 4/2011 Trongjitwikrai et al.
7,940,487 B1 5/2011 Krishnan et al.
7,974,038 B2 7/2011 Krishnan et al.
7,980,159 B1 7/2011 Han
7,987,585 B1 8/2011 Klassen et al.
8,066,171 B1 11/2011 Rakpongsiri et al.
8,078,421 B1 12/2011 Shastry et al.
8,092,610 B1 1/2012 Tarrant
8,094,414 B1 1/2012 Cheng et al.
8,098,460 B1 1/2012 Jen et al.
8,127,643 B1 3/2012 Tan
8,135,208 B1 3/2012 Vangal-Ramamurthy
8,162,366 B1 4/2012 Tan et al.
8,168,033 B1 5/2012 Mohamad Nor
8,180,487 B1 5/2012 Vangal-Ramamurthy et al.
8,199,425 B1 6/2012 Gustafson et al.
8,218,256 B1 7/2012 Lin et al.
8,223,448 B1 7/2012 Haw et al.
8,230,570 B1 7/2012 Choong
8,245,601 B1 8/2012 Hastama et al.
8,267,831 B1 9/2012 Olsen et al.
8,270,118 B1 9/2012 Cheng et al.
8,300,338 B1 10/2012 McFadyen
8,307,537 B1 11/2012 Klassen et al.
8,312,585 B1 11/2012 Tarrant
8,322,235 B1 12/2012 Keopuang et al.
8,327,529 B1 12/2012 Tan et al.
8,335,049 B1 12/2012 Liu et al.
8,345,367 B1 1/2013 Tharumalingam
8,356,384 B1 1/2013 Ferre et al.
8,369,073 B2 2/2013 Trinh et al.
8,379,363 B1 2/2013 Kolunthavelu et al.
8,387,631 B1 3/2013 Thonghara et al.
8,424,418 B1 4/2013 Wuester, Sr. et al.
8,424,824 B1 4/2013 Tan et al.
8,432,630 B1 4/2013 Lin et al.
8,432,631 B1 4/2013 Lin et al.
8,447,430 B1 5/2013 Tan et al.
8,447,551 B1 5/2013 Ong et al.
8,451,578 B1 5/2013 Tan et al.
8,453,841 B1 6/2013 James et al.
8,454,755 B1 6/2013 Tan et al.
8,485,772 B1 7/2013 Ismail et al.
8,493,681 B1 7/2013 Selvaraj
8,537,480 B1 9/2013 Haw
8,544,164 B1 10/2013 Cheng et al.
8,547,657 B1 10/2013 Liu et al.
8,553,968 B1 10/2013 Lee et al.
8,561,285 B1 10/2013 Vangal-Ramamurthy et al.
8,565,511 B1 10/2013 Sungkhaphong et al.
8,582,229 B1 11/2013 Krishnan
8,596,107 B1 12/2013 Wongdao et al.
8,605,383 B1 12/2013 Wang et al.
8,640,328 B1 2/2014 Yow et al.
8,650,716 B1 2/2014 Methe et al.
8,653,824 B1 2/2014 Liu et al.
8,662,554 B1 3/2014 Srisupun et al.
8,683,676 B1 4/2014 Wuester, Sr. et al.
8,689,433 B1 4/2014 Choong
8,707,531 B1 4/2014 Sungkhaphong et al.
8,713,333 B1 4/2014 Selvaraj
8,763,790 B1 7/2014 Neamsuwan et al.
8,789,446 B1 7/2014 Sungkhaphong et al.
8,811,135 B1 8/2014 Kasino et al.
2008/0084630 A1 4/2008 Trongjitwikrai et al.
2009/0157848 A1 6/2009 Khoo
2010/0108256 A1 5/2010 Roajanasiri et al.
2010/0132736 A1 * 6/2010 Lin ..... G01R 3/00 134/6
2013/0057986 A1 3/2013 Vangal-Ramamurthy et al.
2013/0248545 A1 9/2013 Thongjitti et al.

* cited by examiner

DISK CLAMP AND MOTOR HUB CLEANING WITH STAMPING ADHESIVE

BACKGROUND

Embodiments relate to the cleaning of selected structures of devices. More particularly, embodiments related to the cleaning of selected structures of data storage devices being manufactured and/or assembled.

DETAILED DESCRIPTION

Figure 1:
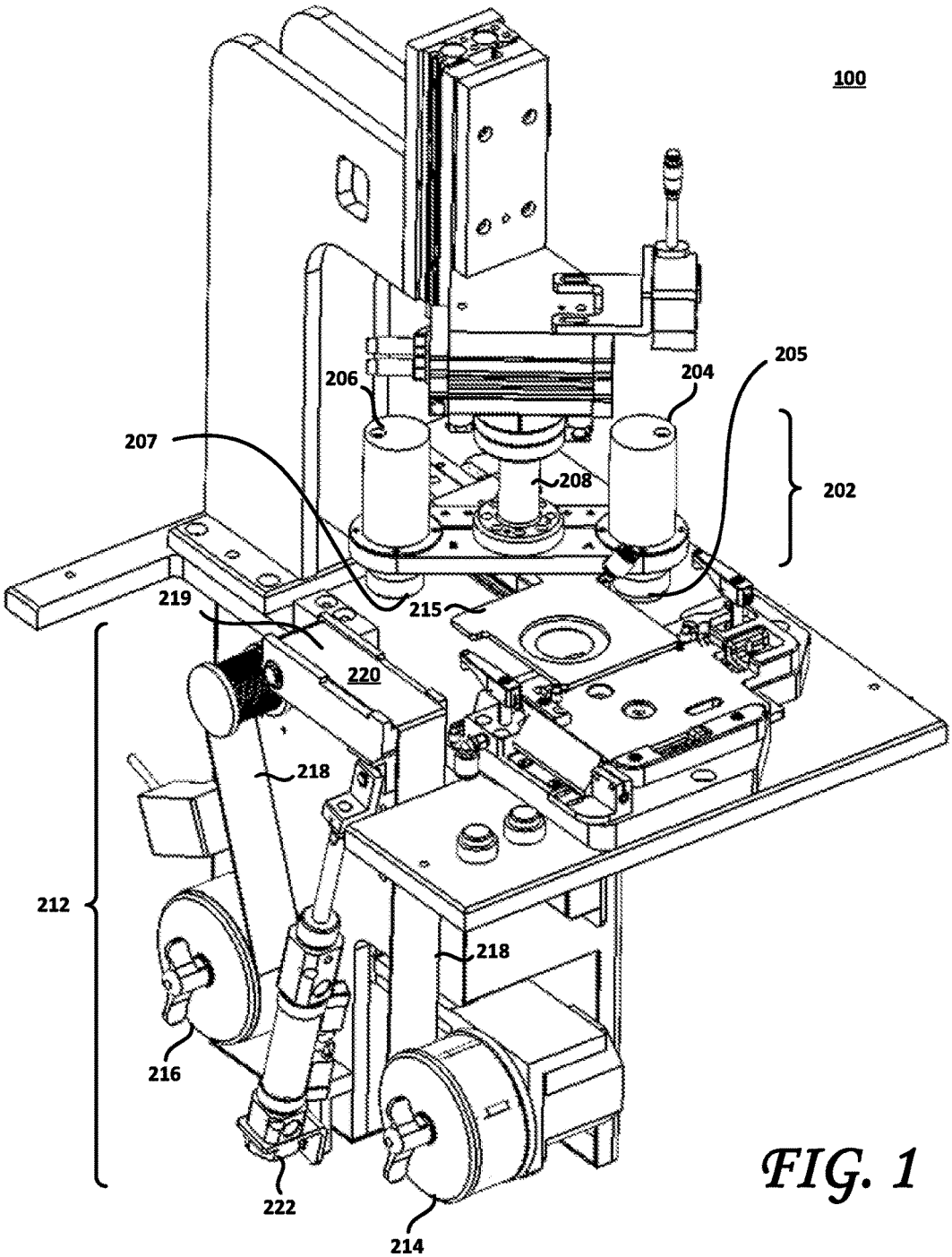
FIG. 1 shows an assembly according to one embodiment.

When a disk pack comprising one or more disk is installed in a data storage device comprising a hard disk drive, the disk pack is fitted on a spindle motor hub and a disk clamp is installed on the motor hub to secure the disk(s) of the disk pack to the hub of the spindle motor. However, friction between the aluminum/stainless steel disk clamp and the aluminum/stainless steel motor hub creates stainless steel and aluminum particulates and debris that contaminate the disk clamp and the motor hub. As a result, the disk clamp and the motor hub need to be cleaned. The disk clamp and motor hub cleaning may be provided by a Clean And Purge (CAP) tool that carries out a vacuum and purge process. However, the CAP tool may cause an oil leak due to differential pressure between the outside environment and the pressurized oil. Removing the CAP tool avoids contaminating the data storage devices with leaking oil, but increases the backend failure rate caused by the aforementioned stainless steel and aluminum particle contamination on the disk clamp and the motor hub.

One embodiment is an assembly configured to clean one or more selected structures of a device. In one embodiment, the device may comprise a data storage device. For example, the data storage device may comprise a solid state data storage device, a hard disk drive and/or a hybrid thereof. In one embodiment, the structure or structures being cleaned are structures of a device being manufactured and/or assembled. For example, one implementation may comprise an assembly as shown FIGS. 1-6, configured to clean structures such as a spindle motor hub and a disk clamp of a data storage device comprising a hard disk drive being manufactured and/or assembled. An exemplary spindle motor hub and disk clamp are shown in FIG. 7 at 702 and 704, respectively. In FIG. 7, the spindle motor, of which only the hub 702 is visible, is configured to rotate the disk 706, which is clamped onto the motor hub 702 by disk clamp 704. The spindle motor may then rotate the disk 602 to thereby enable the head(s) on the actuator assembly 708 to read and write data on the disk 602. However, it is to be noted that embodiments are not limited to cleaning spindle motor hubs and disk clamps of data storage devices. Indeed, embodiments may readily be adapted to the cleaning of other selected structures of other devices, whether already assembled or under manufacture.

Figure 2:
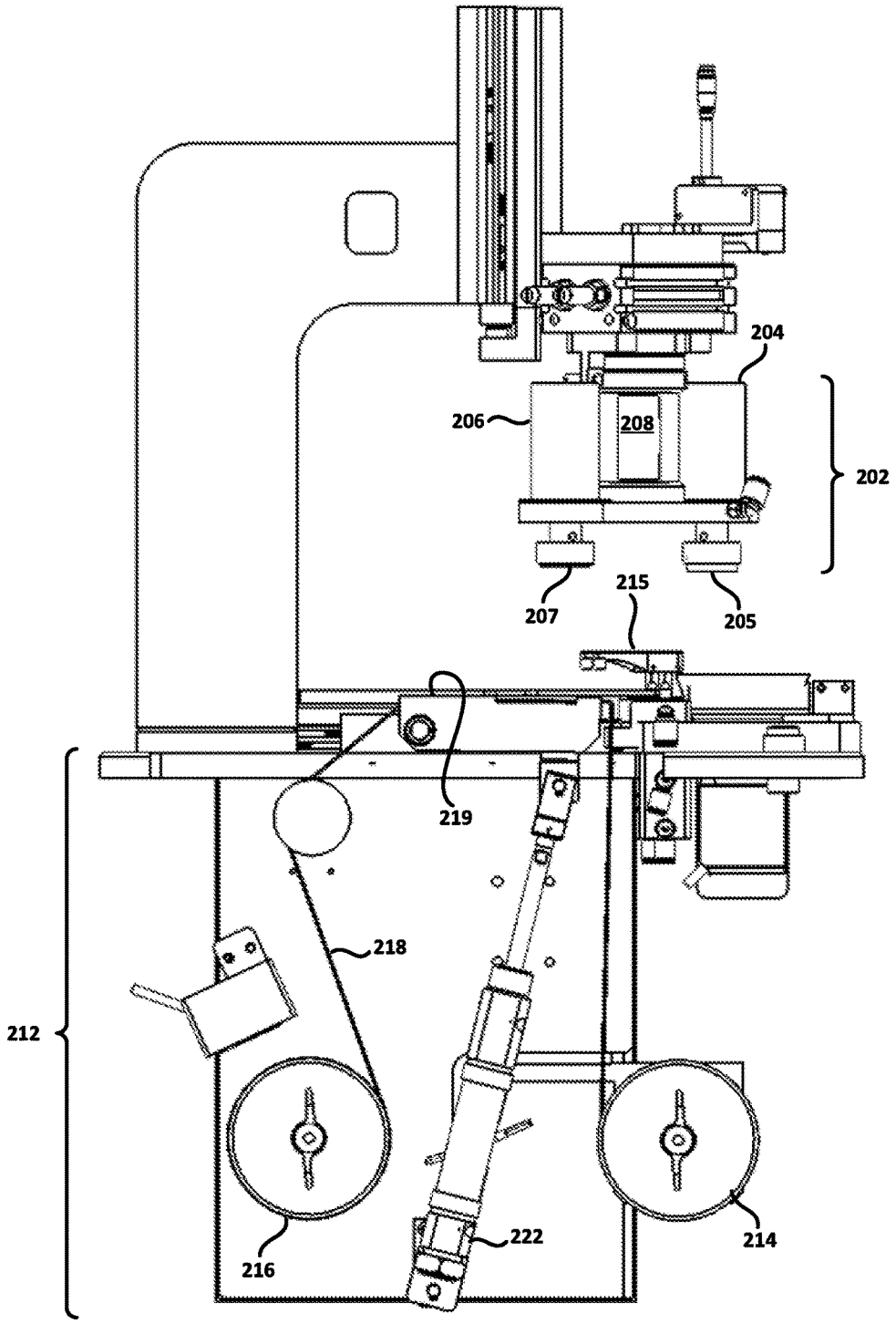
FIG. 2 shows a side view of the assembly of FIG. 1.
Figure 3:
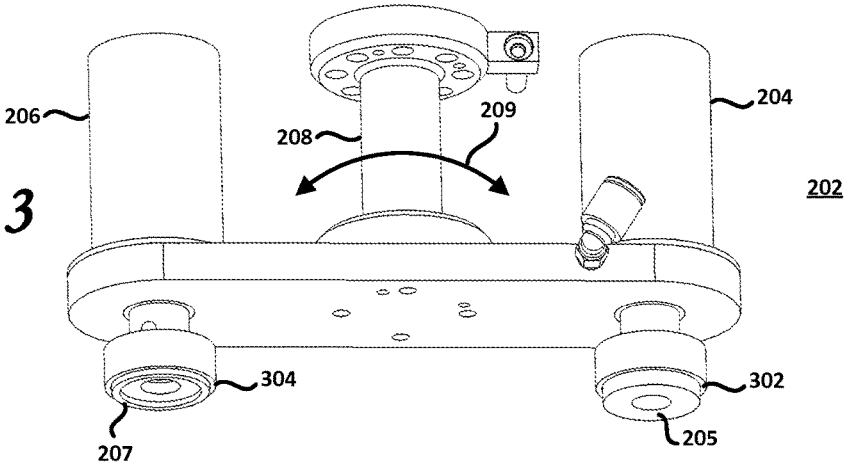
FIG. 3 is a view of an end effector assembly, according to one embodiment.

Collectively referring to FIGS. 1-6, one embodiment is an assembly 100 configured to clean one or more selected structures of a device. The assembly 100 may comprise an end effector assembly 202. Structures of one implementation of such an end effector assembly 202 are also shown in FIG. 3. As shown therein, the end effector assembly 202 may comprise a first end effector 204 and a second end effector 206. The end effector assembly of FIG. 3 is shown, as suggested at 209, as rotatable about an axle 208. In operation, one surface of each of the first and second end effectors faces the selected structure(s) to be cleaned. These surfaces are shown in FIG. 3 at 302 and 304. According to one embodiment and in operation of the assembly 100, the surfaces 302, 304 face the selected structures (such as motor hub 702 and disk clamp 704) to be cleaned, and comprise a layer of material 205, 207. According to one embodiment, the end effector assembly 202 may be configured to selectively move the material 205 or 207 towards and against the selected structure(s) such that the material 205, 207 remains on the facing surface 302, 304 of the end effector assembly 202 and retains, when the end effector assembly 100 is moved away from the device to be cleaned, at least some particulates previously on the selected structure(s).

That is, with reference back to FIG. 3, each of the facing surfaces 302, 304 may comprise a material or layer of material 205, 207 thereon. This material may be configured according to the selected structure that it is to clean. For example, the first end effector 204 comprises a first facing surface 302 onto which a (layer of) material 205 may be disposed. This material 205 may be configured (e.g., with regard to composition, thickness, shape) according to a first selected structure, for example, the motor hub shown at 702 in FIG. 7. Similarly, the second end effector 206 comprises a second facing surface 304 onto which a (layer of) material 207 may be disposed. This material 207 may be configured (e.g., with regard to composition, thickness, shape) according to a second selected structure such as, for example, the disk clamp shown at 704 in FIG. 7. The material 207 may be configured to avoid contact with other, adjacent structures. For example, the material 207 may be configured to contact the motor hub 702 but to avoid contact with the motor hub's tie shaft 705, to avoid oil contamination. For example, the material 207 may have a circular shape that contacts the disk clamp or the motor hub but that includes a center hole or void to avoid making contact with the tie shaft 705.

Figure 6:
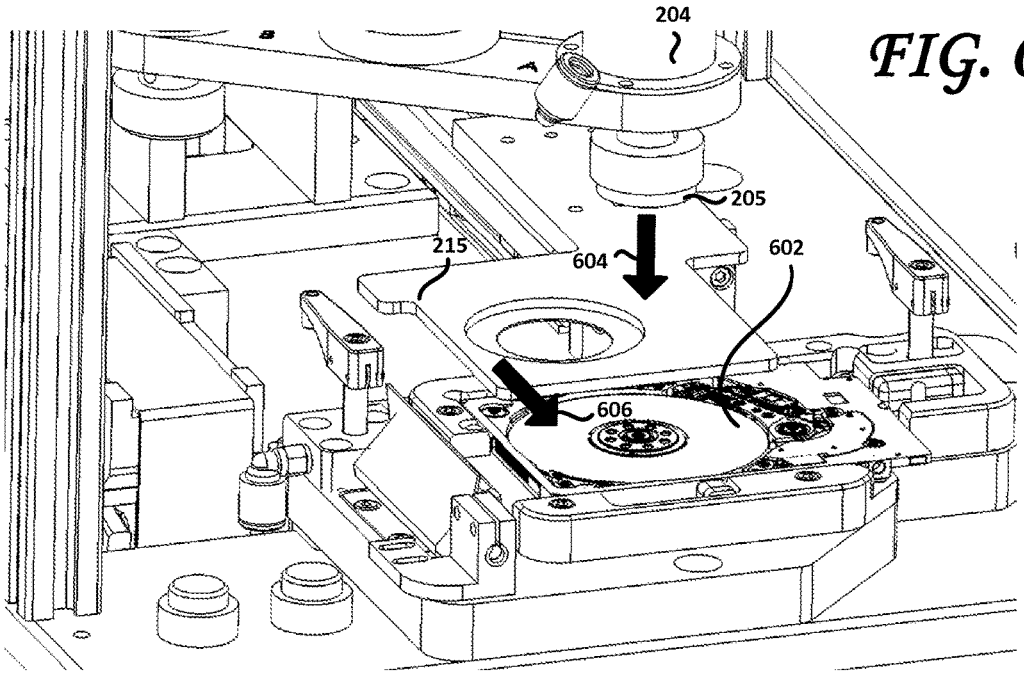
FIG. 6 is a detail of FIG. 5, showing additional features thereof, according to one embodiment.
Figure 7:
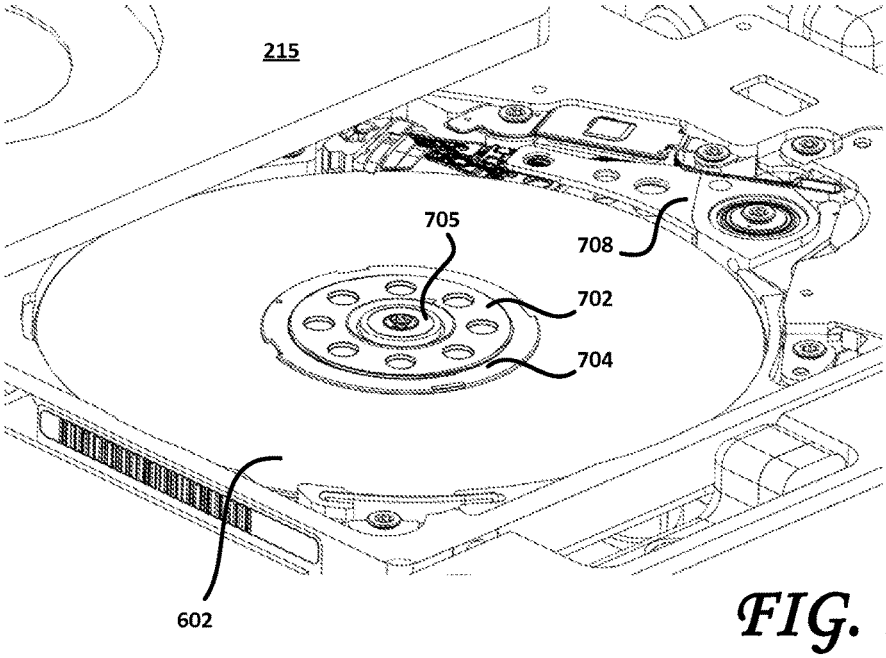
FIG. 7 is another detail of FIG. 5, showing the motor hub and disk clamp of a data storage device with which embodiments may be practiced.

Indeed, as best shown in FIG. 6, the material 205 on the first facing surface of the first end effector 204 may be moved (lowered as suggested at 604 in the implementation shown in FIG. 6) toward a presented data storage device. In so doing, the material 205 may be moved and pressed against the motor hub 702. In an alternative embodiment, the selected structure(s) to be cleaned may be moved towards the material 205 or the material 205 and the selected structure(s) may be moved toward one another. To protect the surface of the disk 602, a protective table 215 may be moved over the disk 602. The protective table 215, as best shown in FIG. 6, may comprise an opening therein to allow the material 205, 207 on the facing surface of the end effector to reach and make contact with the selected structures to be cleaned (in this case, the spindle motor hub and the disk clamp of a data storage device under manufacture). The protective table 215 may be configured to slide into position over the disk 602, as suggested by arrow 606 in FIG. 6. According to one embodiment, the material 205 may be selected such that, when the end effector assembly 202 is moved away from the data storage device, the material 205 remains on the facing surface of the end effector assembly 202 (i.e., it does not become adhered to the selected structure (s)) and retains at least some particulates previously on the motor hub 702. In retaining at least some of the (e.g., aluminum, steel, dust) particulates previously on the motor hub 702, the motor hub 702 is cleaned (or at least rendered cleaner) and rendered ready for next manufacturing steps and/or sealing of the data storage device. According to one embodiment, the material 205 on the facing surface of the end effector assembly 202 may be shaped and selected to be sufficiently thick and compliant as to conform to at least some surface features of the motor hub 702 when moved and pressed there against. The material 205 may be selected to capture at least some of the undesirable particulates that may be present in the motor hub 702. For example, the material may exhibit a selected degree of tackiness that causes particulates to adhere thereto. The material 205 may be conductive and charged to attract particulates on an oppositely-charged device being cleaned. The material 205 may be sufficiently compliant so as to at least partially envelop, encapsulate or invaginate the particulates and lift them off of the selected structure, such as the motor hub 702. The structure and/or material architecture may be selected to achieve the greatest particulate lifting capability and the ability to conform to the surface topology of the selected structure so as to be able to reach within the nooks and crannies of the selected structure, and to lift particulates lying therein away from the surface thereof.

Thereafter, the end effector assembly 202 may be rotated about axis 208 and the second end effector 206 used to move material 207 towards and against the disk clamp 704 to lift at least some of the particulates previously thereon. In each case, the materials 205, 207 may be retained by the first and second end effector 204, 206 as the end effector is moved away from the selected structures to be cleaned. It is to be noted that a same structure may be cleaned by each of the first and second end effectors 204, 206. For example, the first end effector 204 and material 205 may make a first pass at removing at least some particulates from a selected structure and the second end effector 206 and material 207 may make a second pass and clean at least some of the remaining particulates from the same selected structure. Materials 205, 207 may be shaped and configured identically. Alternatively, the materials 205, 207 may be shaped and/or configured differently from one another. As materials 205, 207 may be selected according to the structures to be cleaned and/or the nature of the anticipated particulates, the materials 205, 207 on each of the first and second end effectors 204, 206 may be dissimilar in composition, shape, thickness, porosity, compliance and/or other material characteristics.

According to one embodiment, material 205, 207 may comprise a polymeric adhesive. In one embodiment, at least one of the materials 205, 207 may comprise Dycem®, a material manufactured by Dycem Ltd USA of Warwick, R.I. Indeed, after the Dycem material 205, 207 is stamped onto and contacts with the motor hub 702 and disk clamp 704, it is pulled away as the end effector 204, 206 is moved away from the data storage device. At least some of the particulates on the motor hub 702 and the disk clamp 704 are lifted away, captured by the Dycem material 205, 207. The Dycem material 205, 207 is sufficiently flexible and soft so that it follows, at least to some degree, the contours of the motor hub 702 and of the disk clamp 704 for better cleaning effectiveness. It is to be noted that the material 205, 207 may be molded so as to conform to the shape of the selected structures. That is, the materials 205, 207 may be molded to conform to the shape and surface topography of both the motor hub 702 and the disk clamp 704 or whatever other selected structure is to be cleaned of particulates.

Figure 4:
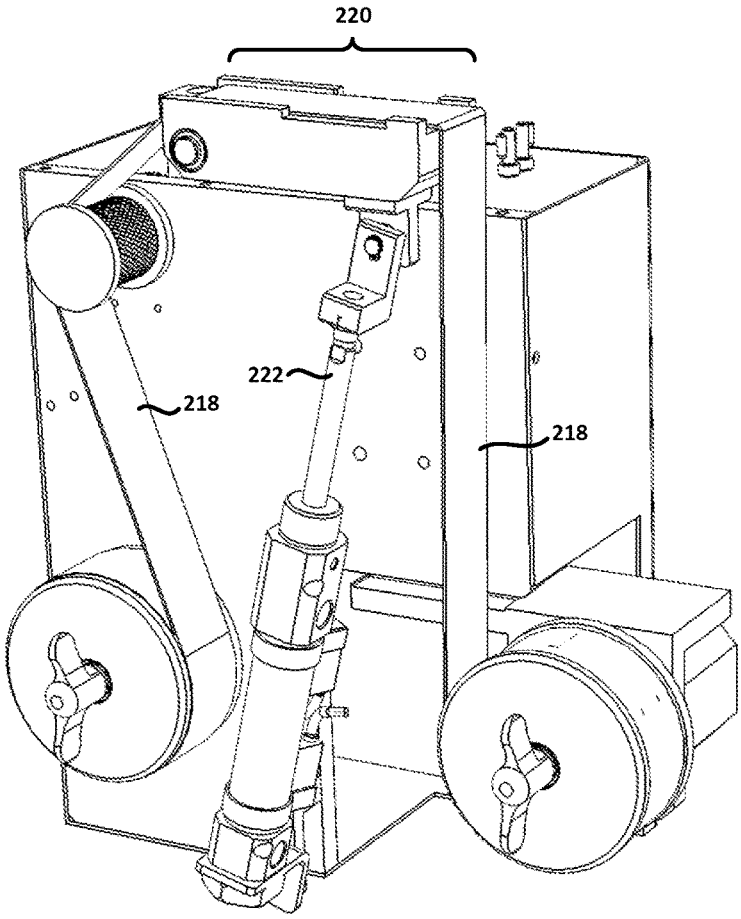
FIG. 4 is a view of a sticky tape dispenser suitable for use with the assembly of FIG. 1, according to one embodiment.
Figure 5:
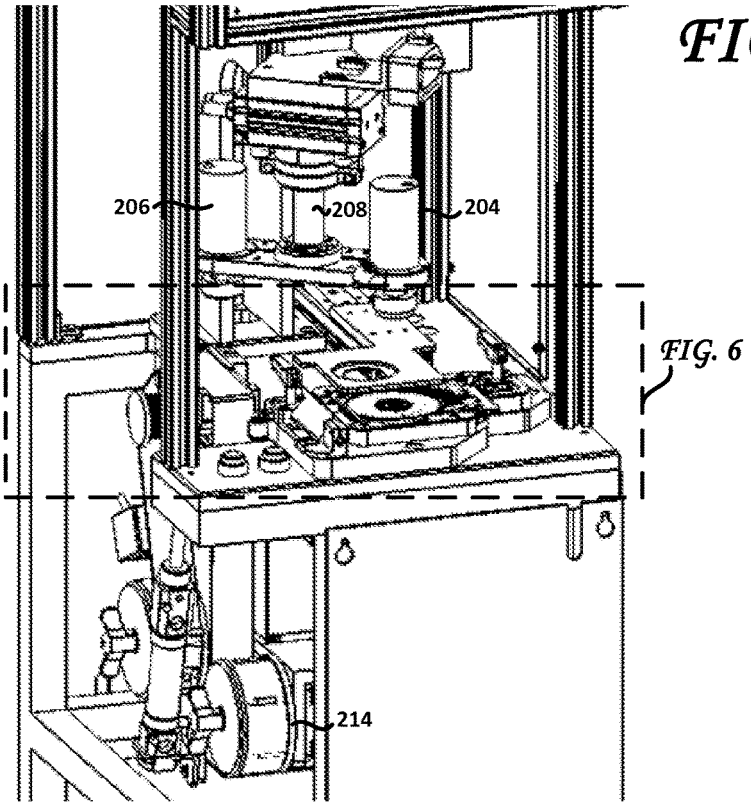
FIG. 5 shows a portion of the assembly of FIG. 1, together with a presented data storage device being manufactured, according to one embodiment.

According to one embodiment, the material 205, 207 may be configured to be re-usable. So as not re-contaminate the structures selected for cleaning with particulates captured from a previous pass, the materials 205, 207, according to one embodiment, may themselves be configured to be cleaned. According to one embodiment, the materials 205, 207 may be cleaned of at least some of the particulates and/or undesirable impurities adhered thereto by, for example, pressing the materials 205, 207 against sticky tape (or other functionally-similar surface), to which at least some of the particulates previously adhered to the material 205, 207 would stick. Best results may be obtained if a clean portion 220 of sticky tape is presented to the materials 205, 207 each time the materials 205, 207 are to be cleaned. Toward that end, the end effector 204, 206 may be configured to press the material 205, 207 with the retained particulates against a (preferably, clean) portion of the sticky tape, such that at least some of the particulates retained by the material 205, 207 adhere to the portion of the sticky tape. For that purpose, the assembly 100 may comprise a sticky tape dispenser 212 as best shown in FIGS. 1, 2 and 4. As shown therein, the sticky tape dispenser 212 may be loaded with a roll of sticky tape 218, dispensed from a first roll 216 and taken up by a second roll 214. The sticky tape 218 may be routed over a tape presenting surface 219 that may be dimensioned to accommodate the material 205, 207. By pressing the materials 205, 207 with the retained particulates against the tape presenting surface 219 over which a clean portion 220 of sticky tape 218 is stretched, the particulates formerly captured by the materials 205, 207 may be transferred onto the sticky tape 218. The sticky tape 218 with the transferred particulates now adhered thereto may be advanced (i.e., dispensed by first roll 216 and taken up by second roll 214), so as to cause a clean portion 220 of sticky tape 218 to be presented on the tape presenting surface 219, in anticipation of another end effector cleaning cycle. A tape tensioner 222 may ensure that the sticky tape 218 is tensioned correctly. A new, clean roll may be loaded onto the sticky tape dispenser when all of the sticky tape has been used and taken up by the second roll 214.

Figure 8:
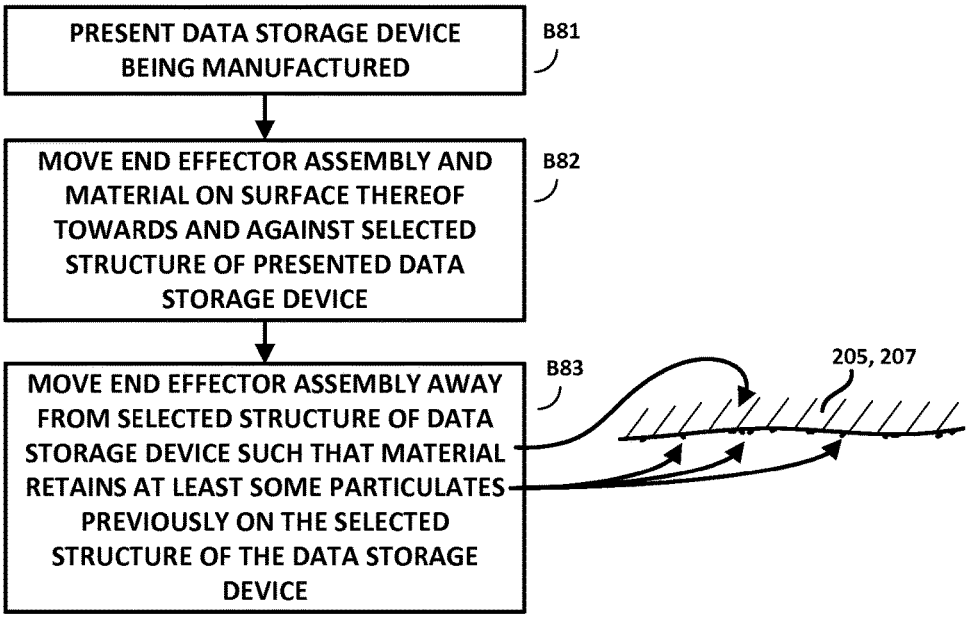
FIG. 8 is a flowchart of a method according to one embodiment.

FIG. 8 is a flowchart of a method according to one embodiment. As shown therein, a method according to one embodiment may comprise presenting a data storage device being manufactured, as shown at B81. The presented data storage device being manufactured may comprise disk 602, a motor configured to rotate the disk 602, the motor comprising a motor hub 702 and a disk clamp 704 configured to clamp the disk 602 onto the motor hub 702. As show at B82, the method may further comprise moving an end effector assembly 202 toward the presented data storage device and against the motor hub 702 and the disk clamp 704, pressing against these selected structures. As shown, the end effector assembly 202 may comprise a material 205, 207 on a surface 302, 304 thereof that faces the motor hub 702 and the disk clamp 704. The end effector assembly 202 may then be moved away from the data storage device, such that the material 205, 207 remains on the facing surface 302, 304 (preferably, none of it remains on the selected structures to be cleaned) of the end effector assembly 202 and retains at least some particulates previously on at least one of the motor hub 702 and the disk clamp 704, as shown (not to scale) to the right of B83 in FIG. 8.

While certain embodiments of the disclosure have been described, these embodiments have been presented by way of example only, and are not intended to limit the scope of the disclosure. Indeed, the novel methods, devices and systems described herein may be embodied in a variety of other forms. Furthermore, various omissions, substitutions and changes in the form of the methods and systems described herein may be made without departing from the spirit of the disclosure. The accompanying claims and their equivalents are intended to cover such forms or modifications as would fall within the scope and spirit of the disclosure. For example, those skilled in the art will appreciate that in various embodiments, the actual physical and logical structures may differ from those shown in the figures. Depending on the embodiment, certain steps described in the example above may be removed, others may be added. Also, the features and attributes of the specific embodiments disclosed above may be combined in different ways to form additional embodiments, all of which fall within the scope of the present disclosure. Although the present disclosure provides certain preferred embodiments and applications, other embodiments that are apparent to those of ordinary skill in the art, including embodiments which do not provide all of the features and advantages set forth herein, are also within the scope of this disclosure. Accordingly, the scope of the present disclosure is intended to be defined only by reference to the appended claims.

The invention claimed is:

1. An assembly configured to clean at least one selected structure of a device, comprising:

an end effector assembly configured to:

provide a material disposed on a facing surface of the end effector assembly that, in operation of the end effector assembly, faces the at least one selected structure of the device;

selectively move the material towards and against the at least one selected structure such that the material remains on the facing surface of the end effector assembly;

retain, in response to the end effector assembly moving away from the device, at least some particulates previously on the at least one selected structure; and press the material with the retained particulates against a portion of a roll of sticky tape, such that at least some of the particulates retained by the material adhere to the portion of the roll of sticky tape.

2. The assembly of claim 1, wherein the material comprises a polymeric adhesive.

3. The assembly of claim 1, wherein the material is re-usable.

4. The assembly of claim 1, wherein the material on the facing surface of the end effector assembly is sufficiently thick and compliant as to conform to at least some surface features of the at least one selected structure of the device in response to the end effector assembly moving against the at least one selected structure.

5. The assembly of claim 1, further comprising a sticky tape dispenser configured to present a clean portion of the roll of sticky tape to the material on the facing surface of the end effector assembly each time the end effector assembly presses the material there against.

6. The assembly of claim 1, wherein the device comprises a data storage device being manufactured.

7. The assembly of claim 1, wherein the end effector assembly comprises:

a first end effector comprising a first layer of material on a first surface thereof facing a first selected structure of the device; and a second end effector comprising a second layer of material on a second surface facing a second selected structure of the device.

8. The assembly of claim 7, wherein:

the first end effector, first surface and first layer of material are configured to remove particulates from the first selected structure; and the second end effector, the second surface and the second layer of material are configured to remove particulates from the second selected structure.

9. The assembly of claim 7, wherein:

the device comprises a data storage device being manufactured;

the first selected structure comprises a hub of a motor configured to rotate a disk;

the second selected structure comprises a disk clamp configured to clamp the disk against the hub of the motor; and the first and second layers of material are shaped so as to at least partially conform to at least some features of the motor hub and disk clamp, respectively.

10. A method for cleaning at least one selected structure of a device using an assembly comprising an end effector assembly, the method comprising:

disposing a material on a facing surface of the end effector assembly that, in operation of the assembly, faces the at least one selected structure of the device;

selectively moving, by the end effector assembly, the material towards and against the at least one selected structure such that the material remains on the facing surface of the end effector assembly;

retaining, in response to the end effector assembly moving away from the device, at least some particulates previously on the at least one selected structure; and pressing, by the end effector assembly, the material with the retained particulates against a portion of a roll of sticky tape, such that at least some of the particulates retained by the material adhere to the portion of the roll of sticky tape.

11. The method of claim 10, wherein the material comprises a polymeric adhesive.

12. The method of claim 10, wherein the material is re-usable.

13. The method of claim 10, wherein the material on the facing surface of the end effector assembly is sufficiently thick and compliant as to conform to at least some surface features of the at least one selected structure of the device in response to the end effector assembly moving against the at least one selected structure.

14. The method of claim 10, further comprising:

presenting a clean portion of the roll of sticky tape to the material on the facing surface of the end effector assembly each time the end effector assembly presses the material there against.

15. The method of claim 10, wherein the device comprises a data storage device being manufactured.

16. The method of claim 10, wherein the end effector assembly comprises:

a first end effector comprising a first layer of material on a first surface thereof facing a first selected structure of the device; and a second end effector comprising a second layer of material on a second surface facing a second selected structure of the device.

17. The method of claim 16, wherein:

the first end effector, first surface and first layer of material are configured to remove particulates from the first selected structure; and the second end effector, the second surface and the second layer of material are configured to remove particulates from the second selected structure.

18. The method of claim 16, wherein:

the device comprises a data storage device being manufactured;

the first selected structure comprises a hub of a motor configured to rotate a disk;

the second selected structure comprises a disk clamp configured to clamp the disk against the hub of the motor; and the first and second layers of material are shaped so as to at least partially conform to at least some features of the motor hub and disk clamp, respectively.

19. The method of claim 10, further comprising advancing the roll of sticky tape so as to present a clean portion thereof for a next cleaning of the material on the facing surface of the end effector assembly.

* * * * *